US008695117B1

(12) United States Patent
Machuca

(10) Patent No.: US 8,695,117 B1
(45) Date of Patent: Apr. 15, 2014

(54) SKYDIVING GARMENT WITH ENHANCED AERODYNAMIC CONTROL

(76) Inventor: Fidel Machuca, Parlin, NJ (US)

( * ) Notice: Subject to any disclaimer, the term of this patent is extended or adjusted under 35 U.S.C. 154(b) by 25 days.

(21) Appl. No.: 13/437,585

(22) Filed: Apr. 2, 2012

(51) Int. Cl.
*A41D 13/00* (2006.01)

(52) U.S. Cl.
USPC ..... 2/69

(58) Field of Classification Search
USPC ..... 2/69, 88, 79, 227; 244/143
See application file for complete search history.

(56) References Cited

U.S. PATENT DOCUMENTS 1,178,165 A * 4/1916 Lupton ..... 280/810
1,257,049 A * 2/1918 Tataryn ..... 244/142
2,067,423 A * 1/1937 Sohn et al. ..... 244/16
2,181,326 A * 11/1939 Griffin ..... 244/16
2,213,754 A * 9/1940 Thirring ..... 280/810
4,220,299 A * 9/1980 Motter ..... 244/143
4,884,768 A * 12/1989 Ansley ..... 244/143
5,176,600 A * 1/1993 Wilkinson ..... 482/124
5,890,225 A * 4/1999 Marschall ..... 2/69
6,065,416 A * 5/2000 Araeen ..... 114/102.11
6,401,249 B2 * 6/2002 Haar et al. ..... 2/69
2008/0276357 A1 * 11/2008 Sigmon et al. ..... 2/458
2012/0153088 A1 * 6/2012 Lokeberg et al. ..... 244/4 A

* cited by examiner

*Primary Examiner* — Danny Worrell
(74) *Attorney, Agent, or Firm* — Luis Figarella

(57) ABSTRACT

A skydiving garment provides a wearer with enhanced control, maneuverability, and extended gliding range during free-fall. The garment includes ram-air structures that form under the sleeves, between the legs and around other selected parts of the wearer's body respectively. There are ram air pocket entries to these ram-air structures, improved zippers and zipper release mechanisms, all to provide increased safety during launch, glide, parachute opening and landing.

7 Claims, 16 Drawing Sheets

202

204

206

SKYDIVING GARMENT WITH ENHANCED AERODYNAMIC CONTROL

PATENTS CITED

The following documents and references are incorporated by reference in their entirety; Tatrin (U.S. Pat. No. 1,257,049), Ansley (U.S. Pat. No. 4,884,768) or Sohn et al (U.S. Pat. No. 2,067,423).

FIELD OF THE INVENTION

This invention relates to a jumpsuit for controlled freefalling, and more particularly to a jumpsuit having expansible ram-air formed wing areas around the body, and means for controlling the expansion and contraction of these wing areas.

DESCRIPTION OF THE RELATED ART

Parachuting often includes "free-fall" between exiting an aircraft and the deployment of a parachute. During free-fall, the parachutist configures his/her body to maneuver through the air, adjust fall rate, and control lateral movement with respect to the ground. While free-falling, parachutists face the earth, the back is arched, the pelvis is down, the arms are out with elbows bent, and the legs are bent at the knees with the feet extending upwards away from the earth.

Jumpers look to expand their time in the air, with the extreme being military jumpers who practice HALO (High-altitude, Low opening), whereas they jump from an aircraft at commercial cruising altitudes (e.g. 10,000 meters) and glide until no more than 200 meters above the target. In this fashion, the jumper resembles an aircraft (albeit a glider), and both commercial and military jumpers desire maximum gliding range.

Of course, unlike a glider, all lift assisting and control surfaces must be collapsible to the point of allowing the jumper to both exit the aircraft, deploy the parachute, and land. For this reason, most previous efforts have consisted of arrangements that replicate animals such as flying squirrels. Such is the case of Tatrin (U.S. Pat. No. 1,257,049), Ansley (U.S. Pat. No. 4,884,768) or Sohn et al (U.S. Pat. No. 2,067,423), the proceedings of which are all incorporated herein by reference.

These have all shown a limitation, evident in their performance. There remains a need for a collapsible jumpsuit implementing lift assisting and control surfaces that will enhance the gliding performance of jumpers.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is a skydiving garment comprising, a suit adapted to fit the wearer, said suit having interconnected torso, groin, sleeves and leg portions; said suit having two or more expansible ram-air formed wing portions interconnecting each said sleeve portion with said torso portion, each said wing being formed of two or more interconnected air chambers, said chambers having one or more air scoops and one or more air exit openings; and said suit having an expansible ram-air formed tail portion interconnecting each said leg portions with said groin portion, said tail having two or more interconnected air chamber, said chambers having one or more air scoops and one or more air exit openings. In another aspect the entry opening to at least one said air scoop is angled. In yet another aspect the edges of the tail portion are connected to the legs of the user via releasable mechanical attachment means; and the upper portion of each wing portion is attached to the sleeve portion via releasable mechanical attachment means.

In another aspect, said leg releasable mechanical attachment means are comprised of a leg lanyard covered by a flap whose distal end is attached to a zipper. In one aspect, said sleeve releasable mechanical attachment means are comprised of a shoulder lanyard covered by a flap whose length attaches grummets and loops to each other. In yet another aspect, said shoulder lanyard is linked to the parachute risers. In one aspect, removable or fixed fans, blowers or ducted fans are fitted into the air scoops.

Other features and advantages of the present invention will become apparent upon examining the following detailed description of an embodiment thereof, taken in conjunction with the attached drawings.

The above-described and other features will be appreciated and understood by those skilled in the art from the following detailed description, drawings, and appended claims.

DETAILED DESCRIPTION OF THE PREFERRED EMBODIMENT

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Figure 1:
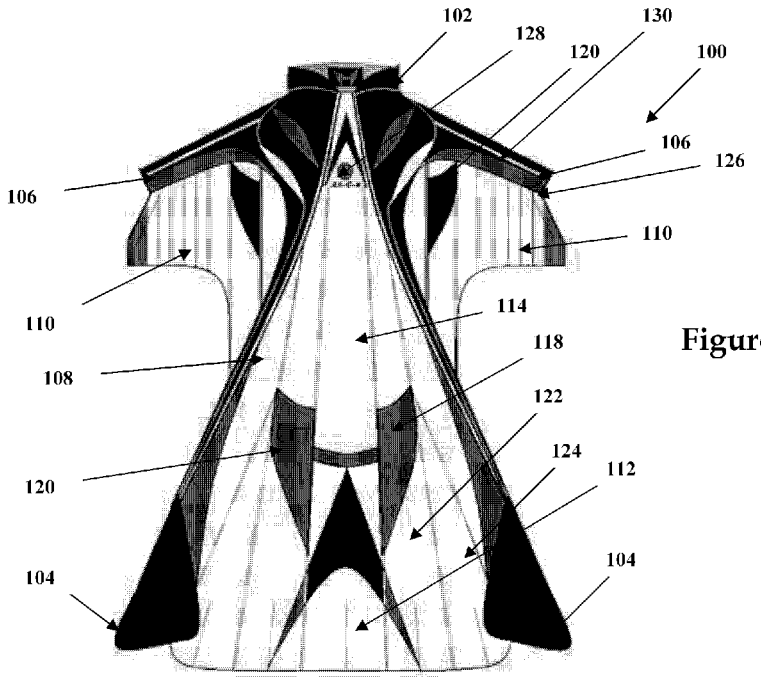
FIGS. 1, 2, 3A-3D show an illustration of a Skydiving garment with enhanced aerodynamic control according to exemplary embodiments of the invention.

Referring to FIG. 1, we see an embodiment 100 of a skydiving garment or bodysuit, according to an exemplary embodiment of the invention. The suit is comprised of interconnected torso 310, groin 312, arm sleeves 314 and leg cover 316 portions. There are neck 102, leg 104 and arm 106 openings. On each side of the torso section 108, there are the lift assist and control surfaces, comprised of wings 110, tail 112 and keel 114.

The wings 110 are comprised of a ram-air inflatable structure spanning the triangular shaped area defined by sides formed by the sleeves and torso of the suit, including all or portions of the user's arms, axilla (or underarm) and torso down to the waist. The tail 112 spans the roughly triangular area defined between the human legs (i.e. from the ankles and the groin). The keel 114 extends from below the neck to the groin area.

Figure 2:
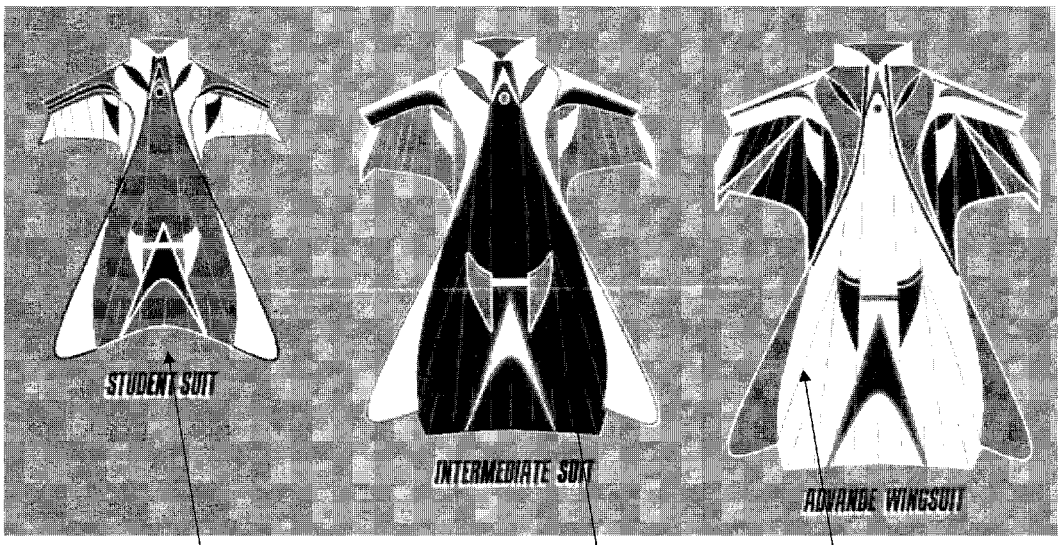
Figure 3A:
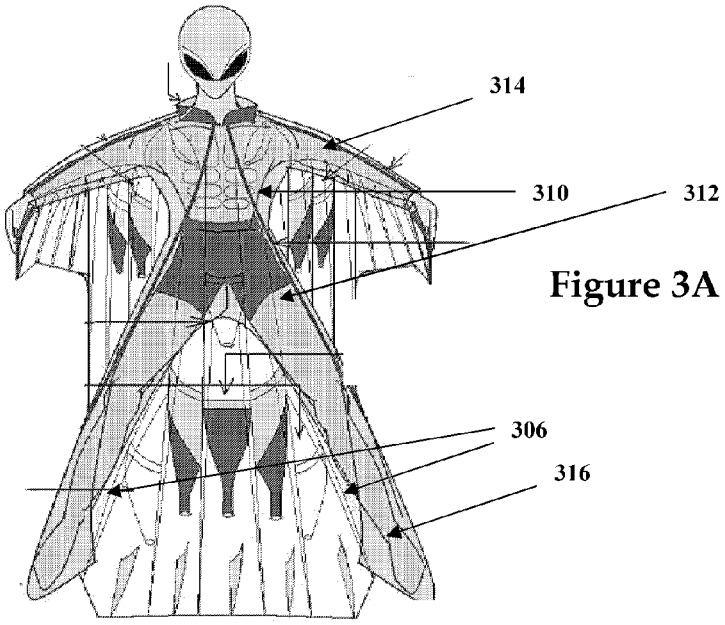
Figure 3B:
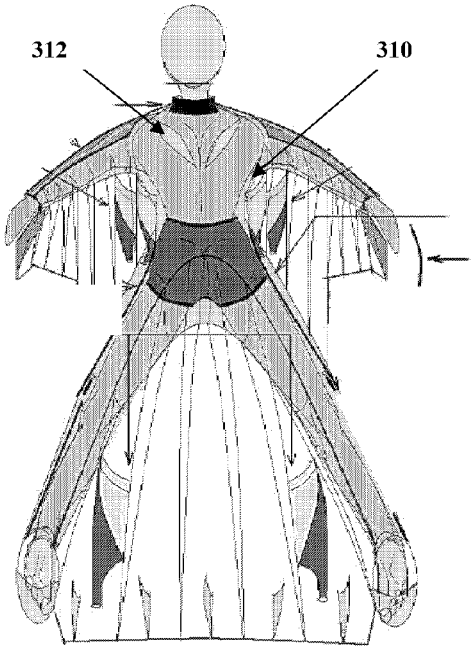
Figure 3C:
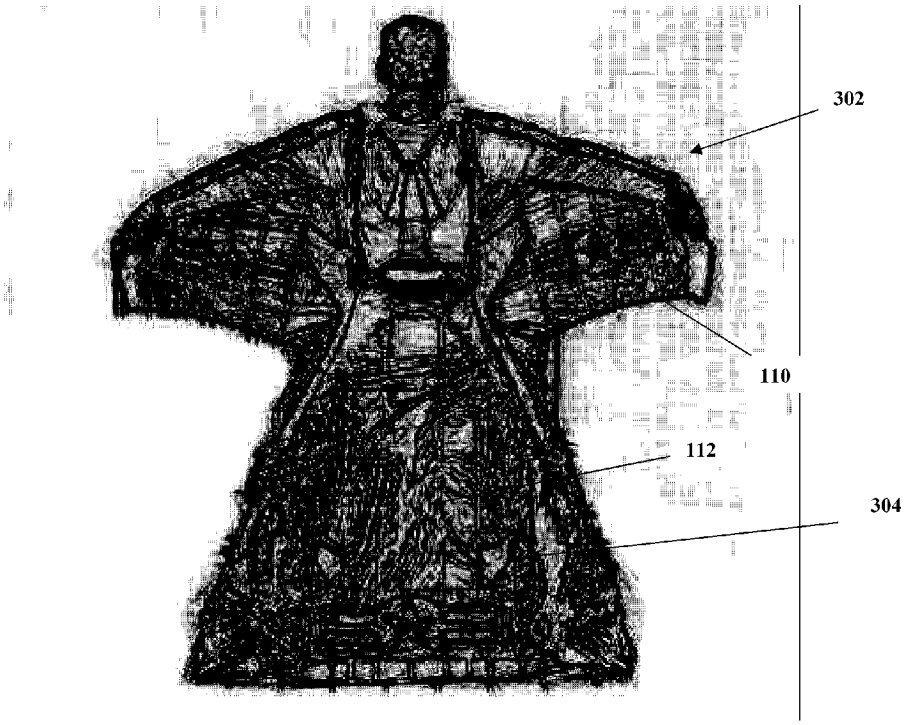
Figure 3D:
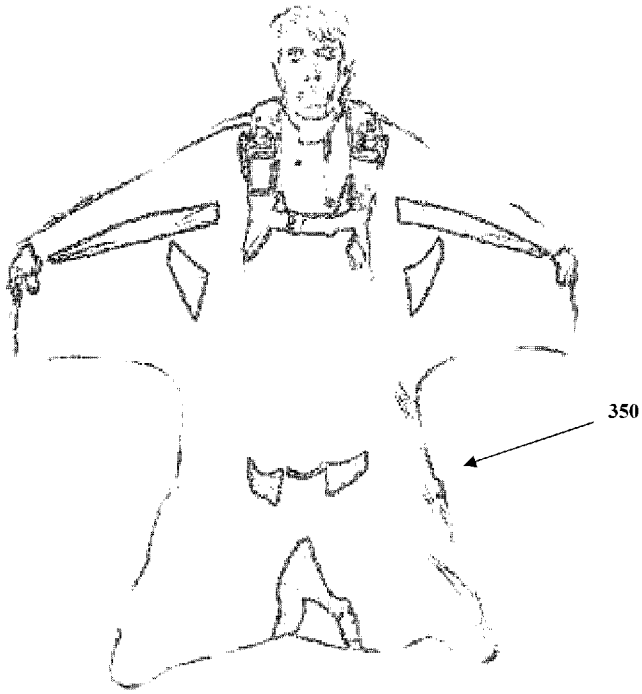

As we see in FIG. 2, these control surfaces may be tailored to the skill of the user. In this fashion, the size of the surfaces may be smallest in a student suit 202, than in a intermediate suit 204, and largest in an advance suit 206. Referring to FIGS. 3A-3D, we shown a back view 302 of the suit, and a front view 350 when a user deploys or "opens" the wings 110 and tail surfaces 112. In one embodiment, the tail 112 section edges are permanently secured to the leg 104 portions. In an alternate embodiment, the sides of the tail 112 are secured to the legs 104 via releasable means 306 (one or more on each side) which extent the all or part of the length of the leg.

Figure 4A:
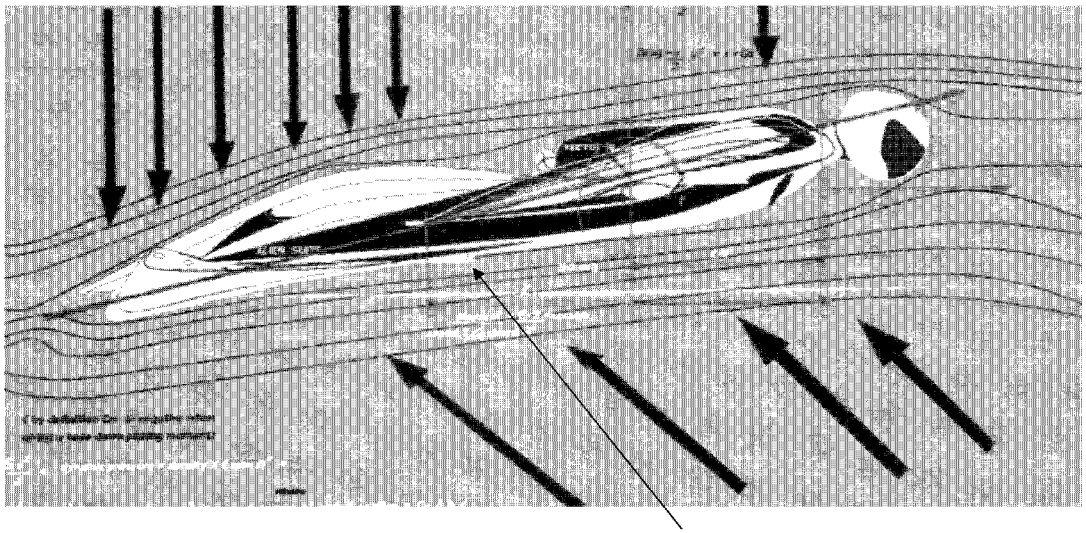
FIGS. 4A-4B show an illustration of the aerodynamic forces on a skydiver during a jump, according to exemplary embodiments of the invention.
Figure 4B:
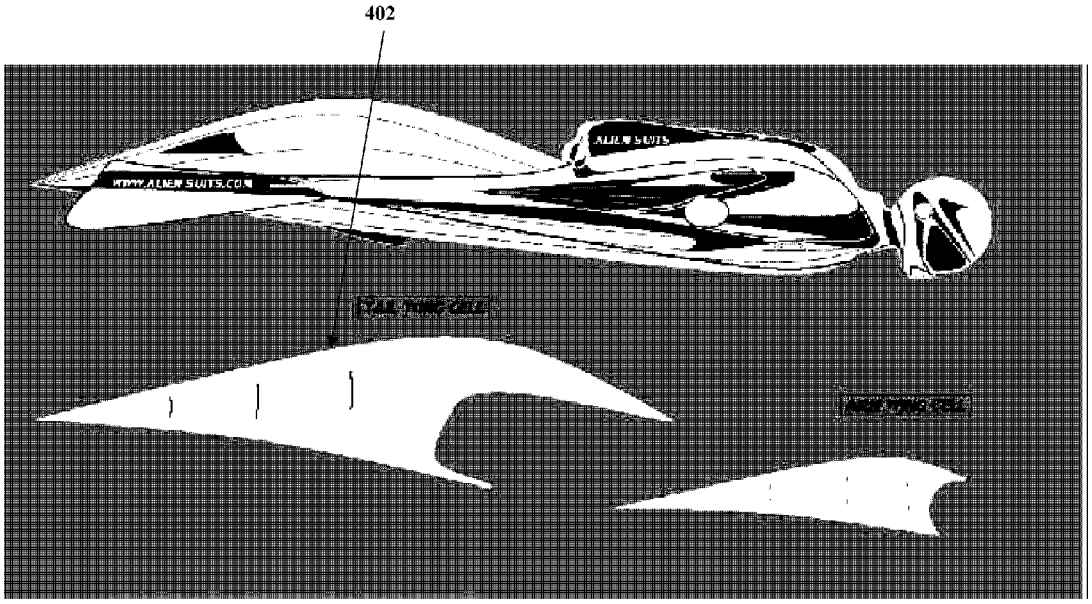

FIGS. 4A-4B illustrates the pressures to which a wearer's body is subjected as they move through the air. It is this movement, in one embodiment, that is used to feed the one or more air scoops 118 that generate the ram air used to inflate the lift assist structures (wing 110, tail 112 and keel 114) through one or more air scoops 118, 120. The intake from these air scoops inflates and flows through a series of chambers sewn into the fabric 122, 124, before exiting through openings. As seen in FIG. 4B, the longer path 402 followed by the air flowing over the wing 110 and tail 112, assists with lift.

Figure 5A:
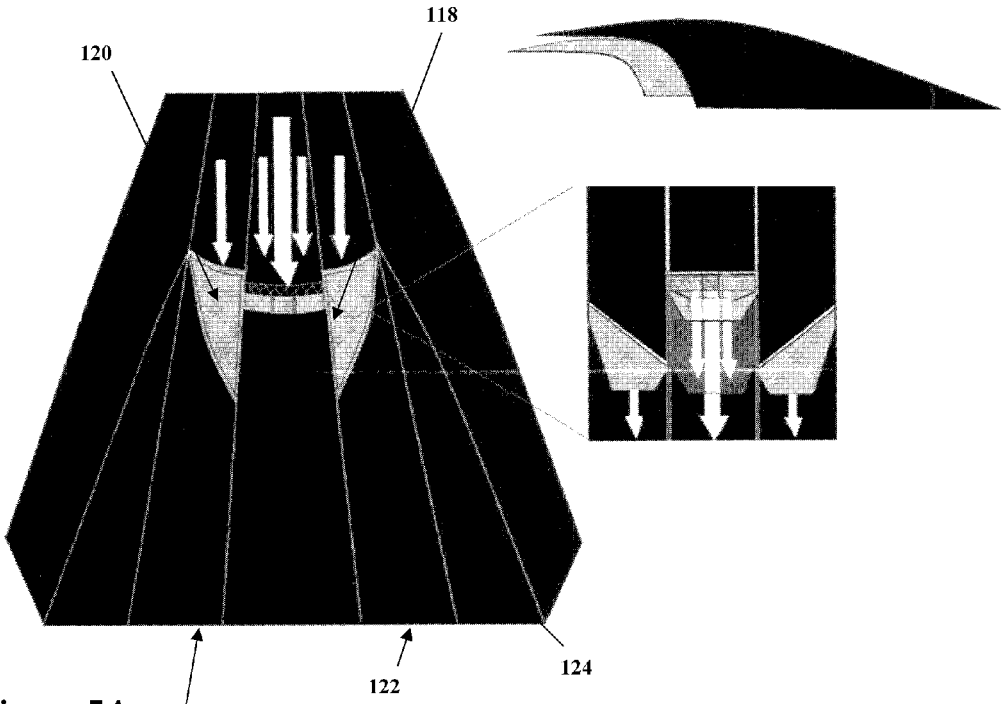
FIGS. 5A-5B and 7A-7B show illustrations of the air scoops according to exemplary embodiments of the invention.
Figure 5B:
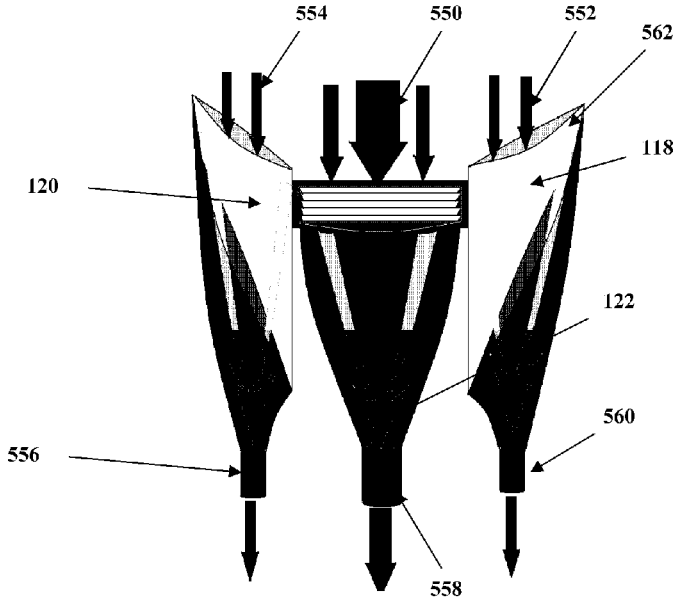
Figure 6A:
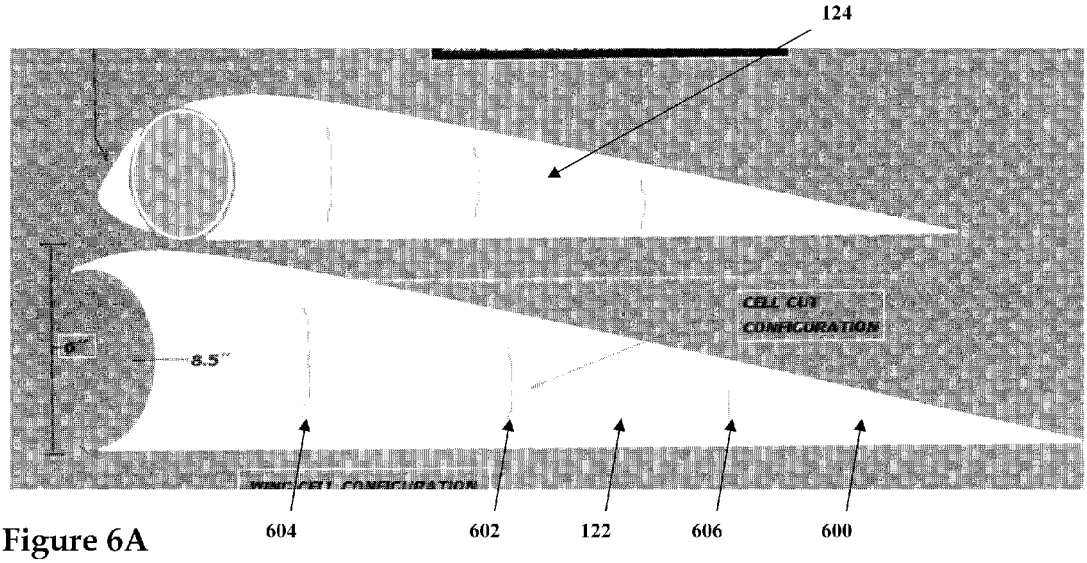
FIGS. 6A-6E show an illustration of the air chamber or baffle walls and valves according to an exemplary embodiment of the invention.
Figure 6B:
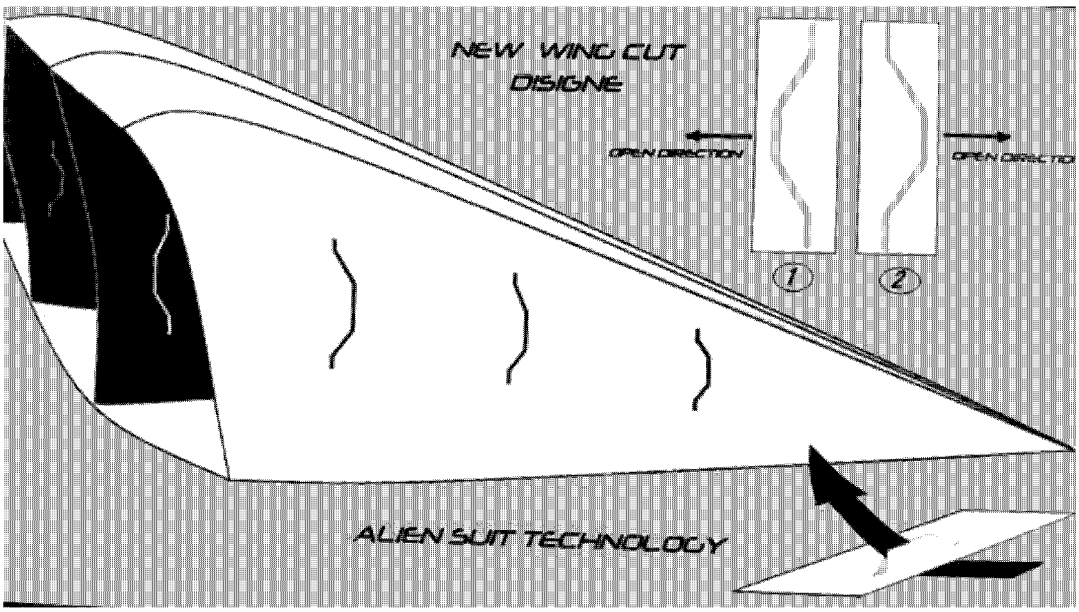
Figure 6C:
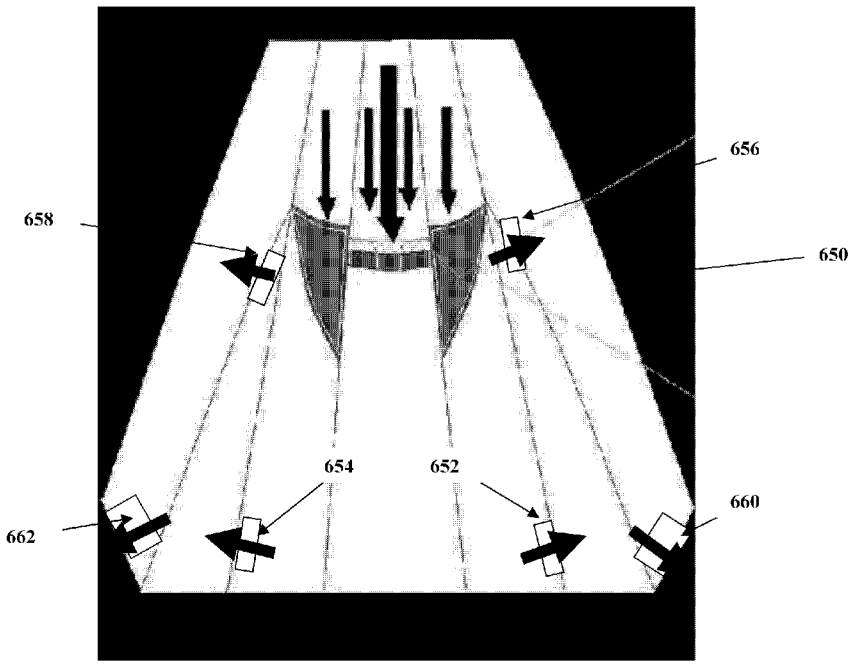
Figure 6D:
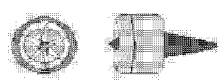
Figure 6E:
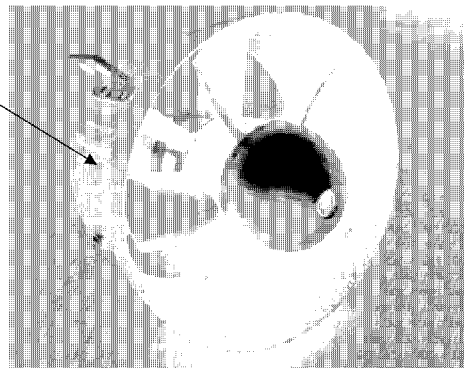

Referring to FIGS. 5A-5B, we illustrate the details of the air scoops 118, 120, 122 feeding two or more chambers 122, 124 that form parts of the tail 112 structure. In one embodiment 122 the scoop is parallel to a line drawn across the body's midsection. In an alternate embodiment, they are curved 118, 120 in order to facilitate the entry of the air. In an alternate embodiment, similar polarity magnets are sewn around the scoop's 118 edge 562, the rejection experienced by similar polarity magnets in opposite sides of the opening helps keep it open.

The air flow 550, 552, 554 entering the scoops 118, 120, 122 is led into a respective chamber or baffle via a narrowed openings 556, 558, 560. These may be shaped as shown (circular), or any other shape which would act as a flow restrictor for air trying to go out back via the scoop. This could potentially include a mechanical air valve. In this fashion, the chamber or baffle 122, 124 acts as a cushioned air member that resists deflating.

In flight, the tail 112 assists in providing pitch control to the free falling jumper, with the respective wings 110 provide both lift and controllability in left/right turning. The keel 114 provides stability assistance to the jumper, as well as providing some directional stability during maneuvers.

FIGS. 6A-6E shows the internal walls separating the chambers or baffles from each other according to an exemplary embodiment. The panel structure walls 600 have one or more valves or slits 602, 604, 606 connecting one chamber 122 to another 124. In this fashion, the air flows in parallel from a chamber closest to the air scoop to another, until it reaches one or more exit openings. In the case of the wing 110, it enters via air scoop 120, flows from one chamber or baffle to another in an outward direction, until it exits via an opening 126 near the hand. Similarly, the air scoops may be located in the back 304.

In an alternate embodiment, the walls are made without the valves or slits 650 and instead the air flow within the cavities is guided to go through connected openings alternatively placed in their connecting walls at their alternating tops and bottoms (652, 652, 654, 656, 658) at their tops and bottoms in a serpentine fashion (top to top, bottom to bottom), so the air flows from one to the other until it gets to the exit opening 660, 662. The same structure within a wing 110 may be accomplished.

Once the air flows, it exits (in the case of the wings 110) via openings are located either near the axilla 310 and/or near the back 312, where the parachute straps enter the suit to secure the jumper's body. In the case of the tail 112, the air escapes through one or more openings near the heel 660, 662 in one embodiment, or an opening near the groin, or a combination thereof.

For base jumpers, who require fast inflation, battery, solar or gas powered fixed or removable fans, blowers or ducted fans 680 may be used to feed air into the chambers or baffles before jumping. In this fashion, the suit is ready to provide lift assistance before jumping. One possible unit would be the Turbax Fan system, used for RC airplanes.

In an alternate embodiment, the fans are wired so that they become generators during descent. In this fashion, the air coming through the air scoops operates as an energy source. This may be used to operate lights, radios and/or safety devices.

Figure 7A:
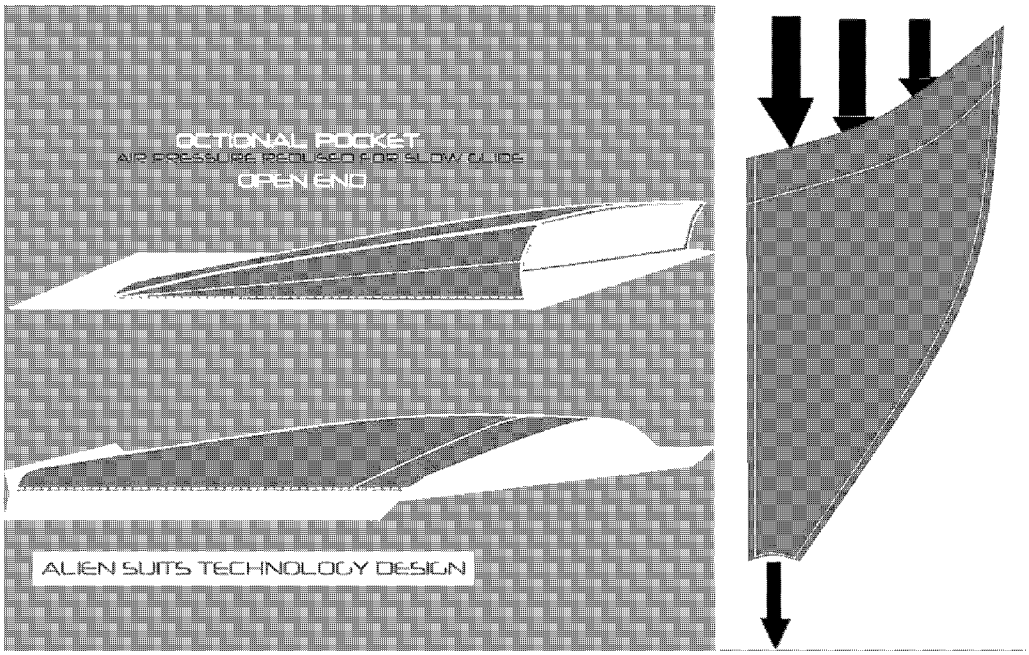
Figure 7B:
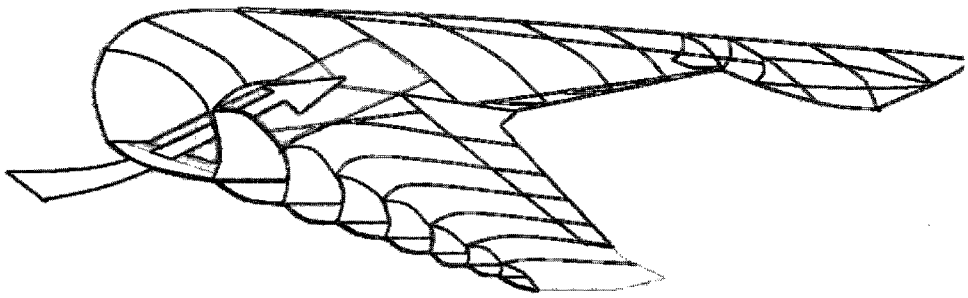

As seen in FIGS. 7A-7B the openings may be curved or squared among many other choices. To facilitate air entry, in an alternate embodiment, similar polarity magnets are sewn around the scoop's 118 edge 562.

Figure 8A:
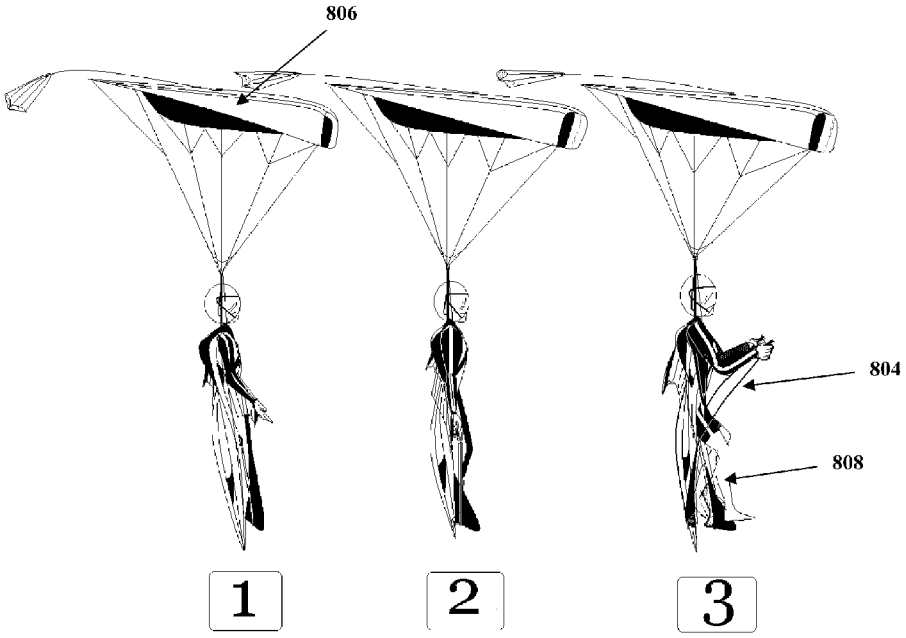
FIGS. 8A-8C show an illustration of the covered release/opening lanyard according to an exemplary embodiment of the invention.
Figure 8B:
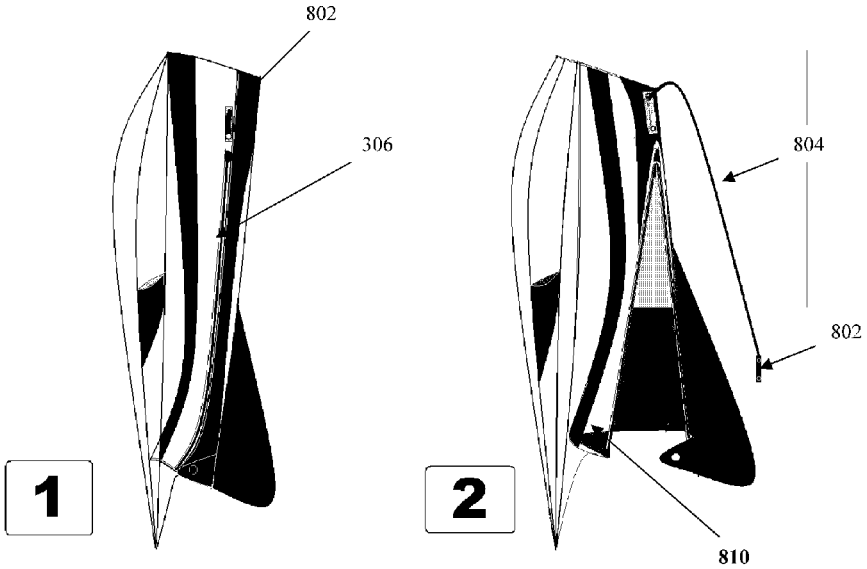
Figure 8C:
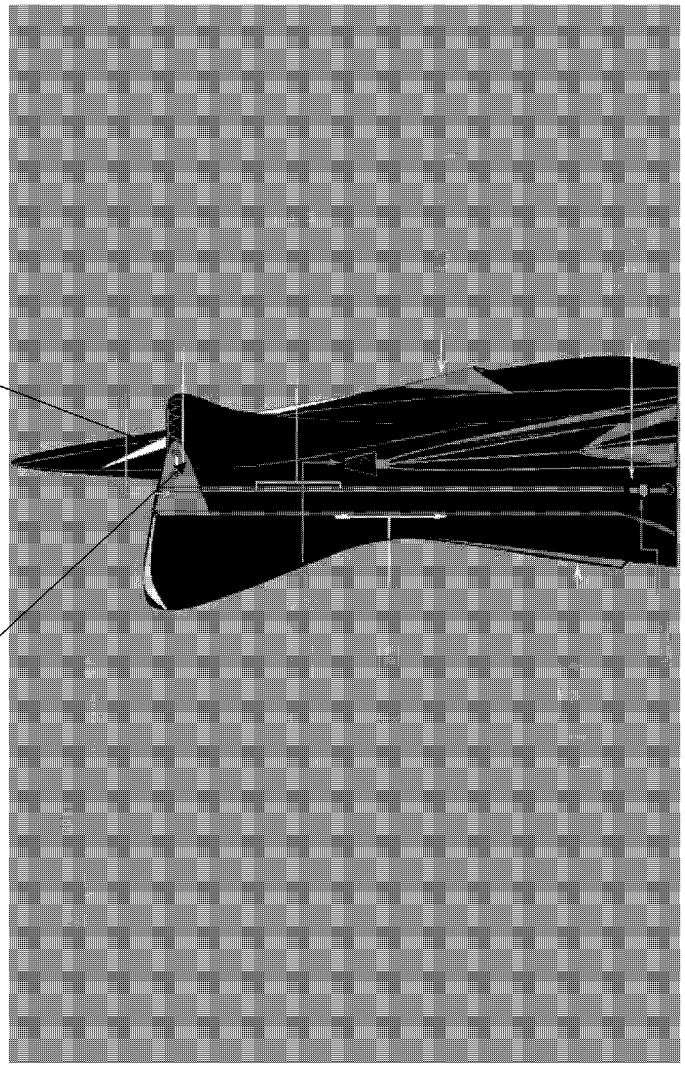

Once the user is ready to deploy the parachute, it becomes an advantage for the user to release the tail 112 edges at the point where they are attached to the inside of the legs of the user. In one embodiment, Referring to FIGS. 8A-8C, the opening tail 112 edges are sawn to the inside of the legs via releasable means 306 along one or both legs, preferably on the inside. In one embodiment, the releasable means are a zippers, which may be C-press seam sealers, particularly when they are exposed to the air stream.

To release, the jumper pulls on the ends 802 of a cord or lanyard 804, at any point during the descent, but preferably after the parachute canopy has opened 806. In this fashion, the user now moving down at a decelerated speed, and the air scoops are not inflating the wings 110 or tail 112. Having the legs free to move 808 allows for a safe landing. The lanyard 804 is covered by a flap 810, which allows for a more aerodynamic assembly, as well as for a safer one, since the lanyard 804 is not capable of tangling with the parachute at the time of opening. Snaps 812 at the bottom and top 814 secure the flap in a closed position.

Figure 9A:
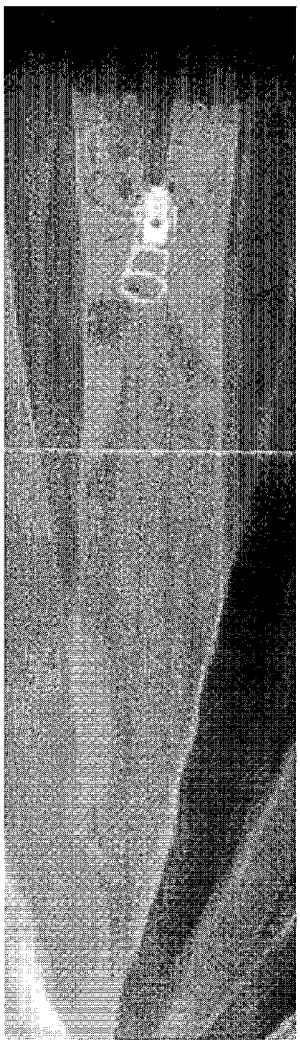
FIGS. 9A-9B show C-press seam zippers.
Figure 9B:
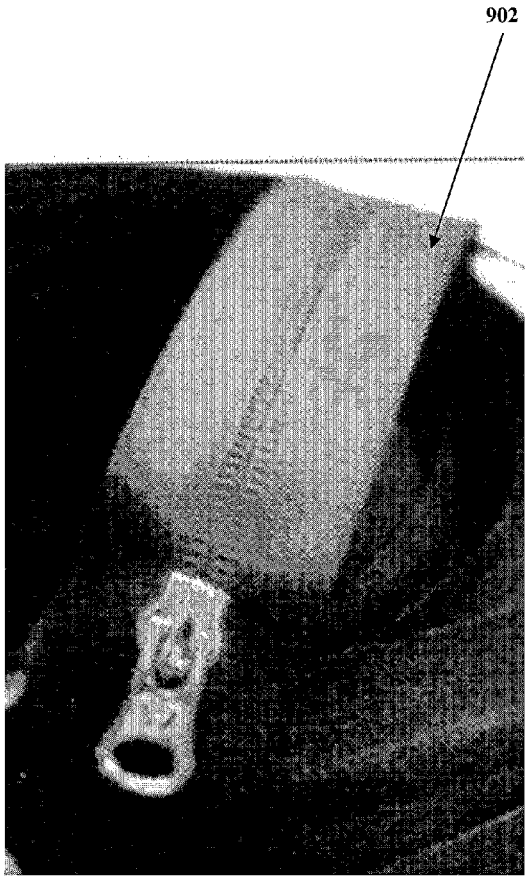
Figure 10A:
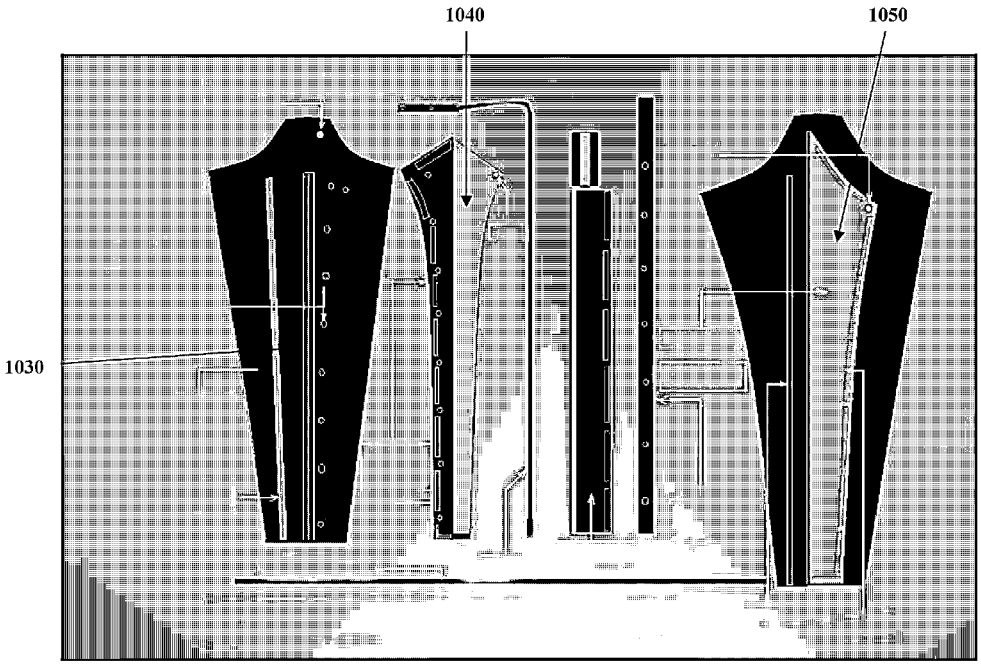
FIGS. 10A-10J show illustrations of the automatic release system and its main components according to exemplary embodiments of the invention.
Figure 10B:
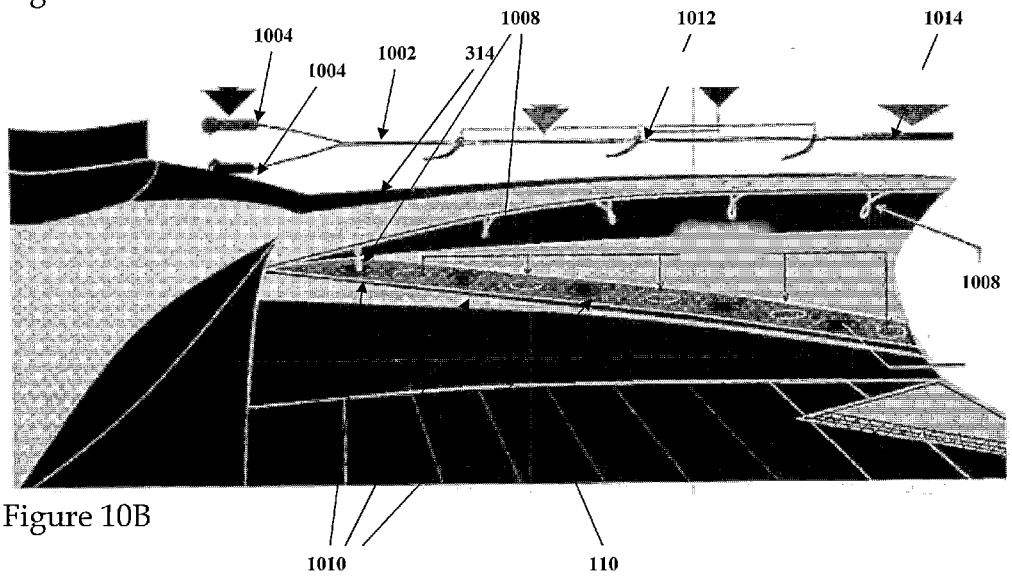
Figure 10C:
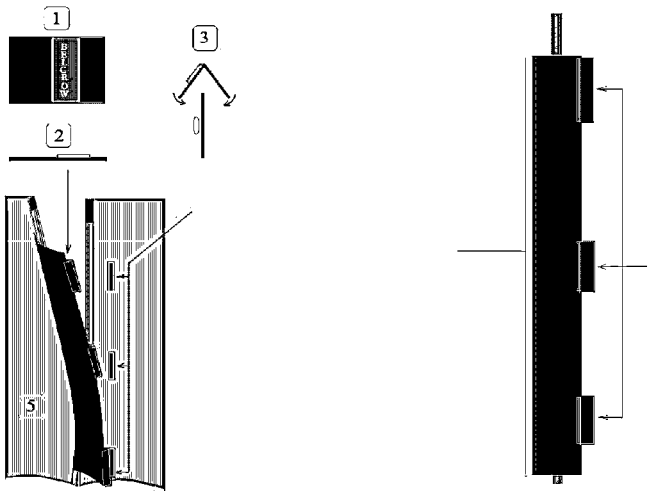
Figure 10D:
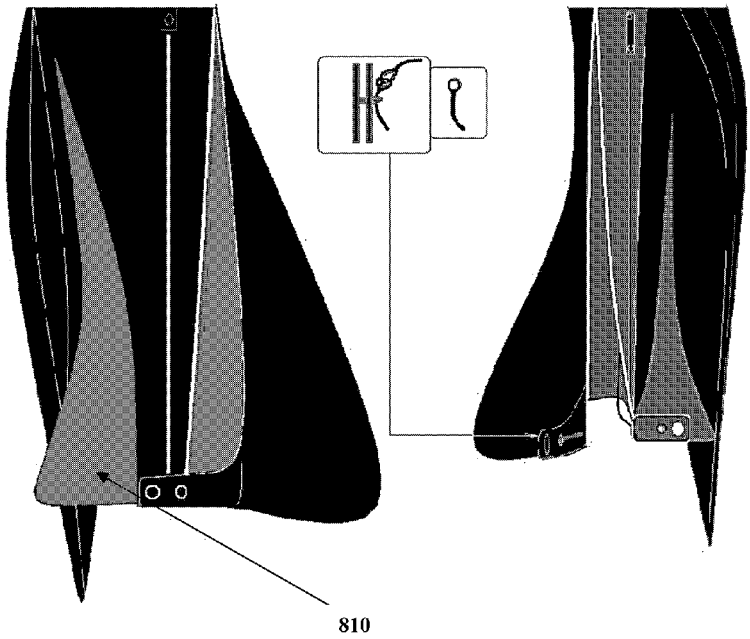
Figure 10E:
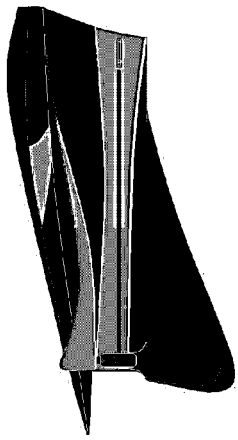
Figure 10F:
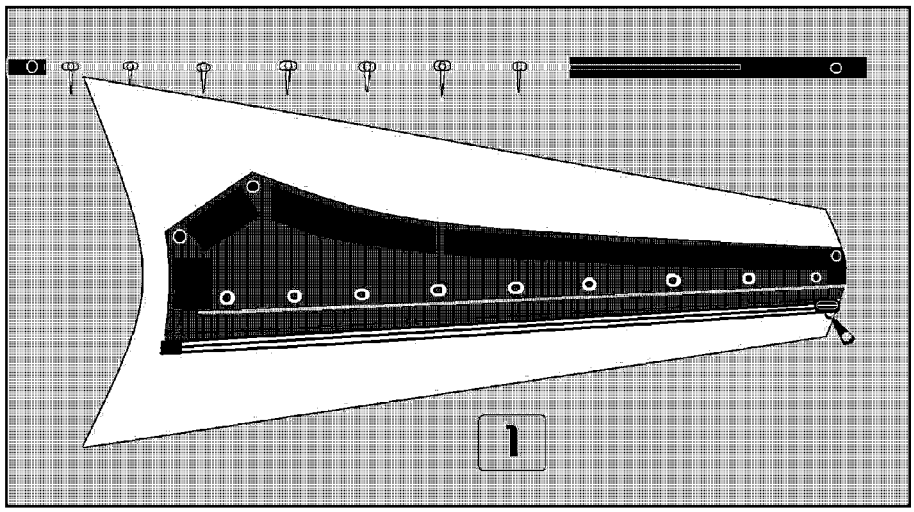
Figure 10G:
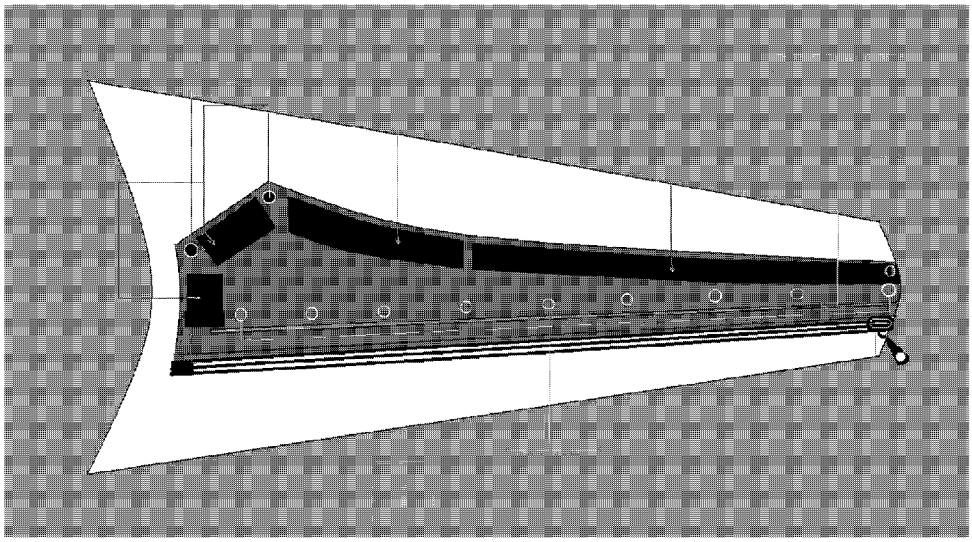
Figure 10H:
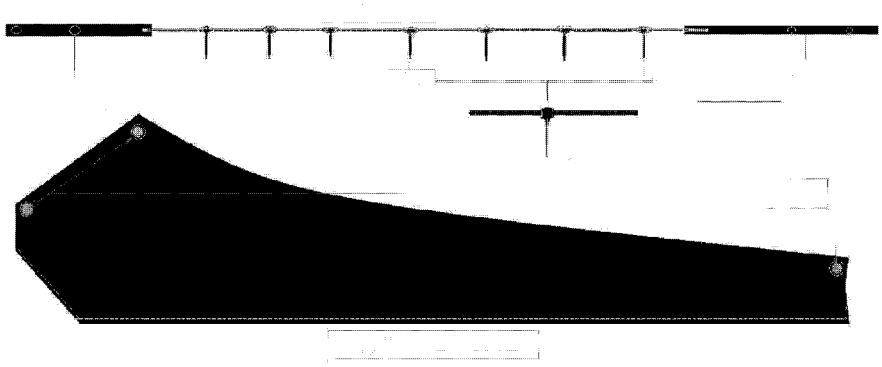
Figure 10I:
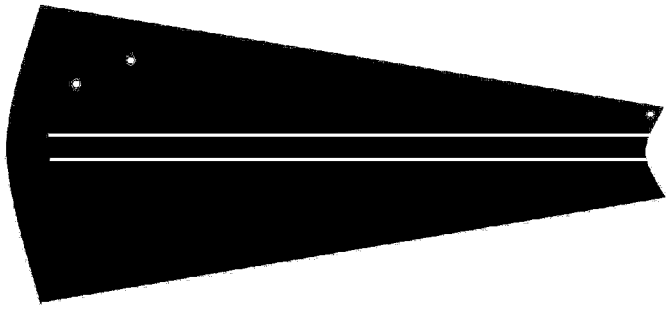
Figure 10J:
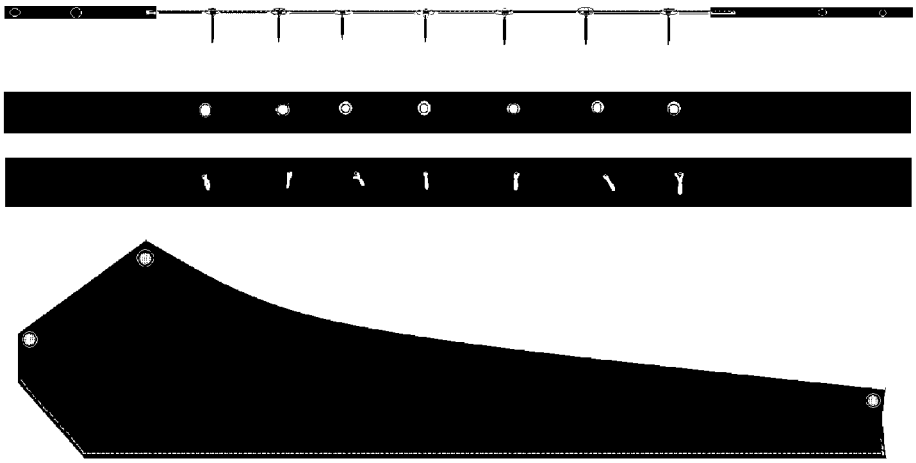

The above covering of the tail 114 releasable means 306, allows for the use of both aerodynamic and non-aerodynamic attachment structures. In one embodiment, they are C-press seam sealer zipper (FIGS. 9A-9B, 902), preferably in the 'reverse' or low profile mode, although either side works. In addition, the releasable means may be Velcro strips, magnetic or other quick release/snap grommets or buttons, grommets with loops, etc. Since they are covered by a flap 810, non aerodynamic methods may be used without severe penalty.

Referring to FIG. 10A-10J, we illustrate an arm sleeve 314 cut away system 100 for release of the force acting on each arm's wing 110. This system may be automatic or manually utilized. Normally, when the user gets ready to deploy the parachute, they do so by bringing their arms close to the torso, therefore reducing the aerodynamic wind entering the wings 110, and easily collapsing them. The user then releases the parachute, upon opening, it would be advantageous then to release the wings 110.

In one embodiment, the attachment means are zippers that runs along the sleeve length, in either the upper or lower portion. In another embodiment, the attachment means 130 securing the top of the wing 110 to the bottom of the arm sleeve 314. As with the leg release means, these may be comprised of zippers, Velcro, buttons, grommets, loops, etc. or any combination thereof. In some other situations, as is the case with many base-jumpers and/or military users with automated parachute opening devices, there may be a need to automatically release the top of the wing 110 from the arm sleeve 314.

To accomplish this, the top of the lanyard 1002 is made to form one or more cut away pullers 1004, 1006, which are connected to the parachute riser. Upon either manual or automated parachute opening, the pullers will be acted upon, effectively displacing the lanyard 1002 upwards along the sleeve, which in turn releases the elastic loops 1008 which are held on the grommets 1010 via the hook pins 1012. In this fashion displacement of the lanyard 1002 (which is held at the wrist end or distal end of the sleeve via an elastic piece 1014) top of the wing 110 structure is loosened from the sleeve 314, freeing the arms of the user to handle the parachute risers and other control features.

As noted, creating the ram-air supported lift assisting surfaces under the arms (or wings 110), tail 112 and keel 114 requires the inflation of the chambers or baffles (such as 122, 124). To assist this structure's integrity, the fabric used in one embodiment may be comprised of single, double or more cloth layers. In an alternate embodiment, the suit fabric is made of a composite sandwich having a denser fabric between the outer and inner skin.

In an alternate embodiment, the exterior surface of the fabric may have diamond or hexagonal shapes. One suggested outside material is the class of 400×300 Denier Cross Dyed Nylon/Polyester Diamond Ripstop Fabric. In one embodiment, the inside material may be 200 denier ripstop. In another embodiment, the there is a middle layer of 70 denier silicone coated ripstop, which acts as a moisture barrier, as well as creating a composite that traps the air inside the air cavities. In other embodiments, the various surfaces may be made of cotton, poly/cotton blends, nylon, spandex, cordura, and parapak.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. A skydiving garment comprising;

a suit having interconnected torso, groin, sleeves and leg portions;

said suit having two or more wing portions interconnecting each said sleeve portion with said torso portion, each said wing portion formed of two or more expansible interconnected chambers, said chambers having one or more openings connected to allow air to enter it through an air scoop at a first end, and one or more exit openings for said air at a second end; and said suit having a tail portion interconnecting each said leg portions with said groin portion, said tail portion having two or more expansible interconnected chambers, said chambers having one or more openings connected to allow air to enter it through an air scoop at a first end, and one or more exit openings for said air at a second end.

2. The garment of claim 1 wherein;

the opening of at least one said air scoop is angled.

3. The garment of claim 2 wherein;

the tail section edges of the tail portion are connected to the legs of the user via releasable mechanical attachment means; and the upper portion of each wing portion is attached to the sleeve portion via releasable mechanical attachment means.

4. The garment of claim 3 wherein;

said releasable mechanical attachment means connecting said edges of the tail portion to said legs of the user are comprised of a leg lanyard covered by a flap whose distal end is attached to a zipper.

5. The garment of claim 4 wherein;

said releasable mechanical attachment means connecting each wing portion to a sleeve portion are comprised of a shoulder lanyard covered by a flap whose length attaches grummets and loops to each other.

6. The garment of claim 5 wherein;

the top of said shoulder lanyard forms one or more cut away pullers which are connected to the parachute riser.

7. The garment of claim 1 wherein;

fans, air blowers or ducted fans are fitted into the air scoop openings.

* * * * *